US009677227B2

(12) United States Patent
Pier et al.

(10) Patent No.: US 9,677,227 B2
(45) Date of Patent: Jun. 13, 2017

(54) AUTOMATIC FEEDBACK SYSTEMS AND METHODS FOR RAILWAY NIPPER MACHINES

(71) Applicant: Nordco Inc., Oak Creek, WI (US)

(72) Inventors: Michael Thomas Pier, Fox Point, WI (US); Jonathan Dale Dickerson, Toledo, IL (US)

(73) Assignee: NORDCO INC., Oak Creek, WI (US)

( * ) Notice: Subject to any disclaimer, the term of this patent is extended or adjusted under 35 U.S.C. 154(b) by 397 days.

(21) Appl. No.: 14/460,228

(22) Filed: Aug. 14, 2014

(65) Prior Publication Data

US 2015/0053108 A1 Feb. 26, 2015

Related U.S. Application Data

(60) Provisional application No. 61/867,820, filed on Aug. 20, 2013.

(51) Int. Cl.
*E01B 29/14* (2006.01)
*E01B 29/26* (2006.01)

(52) U.S. Cl.
CPC ..... *E01B 29/14* (2013.01); *E01B 29/26* (2013.01)

(58) Field of Classification Search
CPC ..... E01B 29/14
See application file for complete search history.

(56) References Cited

U.S. PATENT DOCUMENTS

| | | | | | |
|---|---|---|---|---|---|
| 3,430,578 | A * | 3/1969 | Stewart | E01B 29/14 | 104/7.1 |
| 3,610,158 | A * | 10/1971 | Eidemanis | E01B 29/26 | 104/17.1 |
| 3,753,404 | A * | 8/1973 | Bryan, Jr. | E01B 29/26 | 104/17.1 |
| 4,939,998 | A * | 7/1990 | Theurer | E01B 27/16 | 104/12 |
| 5,191,840 | A * | 3/1993 | Cotic | E01B 29/26 | 104/17.1 |
| 5,586,502 | A * | 12/1996 | Weber | E01B 29/24 | 104/17.2 |
| 6,647,891 | B2 * | 11/2003 | Holmes | E01B 27/00 | 104/2 |
| 7,258,069 | B1 * | 8/2007 | Cotsford | E01B 29/14 | 104/2 |
| 2002/0078853 | A1 * | 6/2002 | Holmes | E01B 27/00 | 104/2 |

* cited by examiner

*Primary Examiner* — Zachary Kuhfuss
(74) *Attorney, Agent, or Firm* — Greer, Burns & Crain, Ltd.

(57) ABSTRACT

A railway nipper machine is provided that includes a nipper frame having a pair of nipper hooks for performing a nipping operation, and a position feedback device having a central control module configured for controlling the nipping operation based on a depth signal and a time signal. Further included in the nipper machine is a depth sensor connected to the position feedback device for generating the depth signal relative to a nipper actuator connected to the nipper frame, wherein the depth sensor transmits the depth signal to the position feedback device. A timer is provided for generating the time signal, and the nipper machine is actuated by the nipper actuator in response to a determination value generated by the position feedback device based on the depth signal and the time signal.

22 Claims, 7 Drawing Sheets

AUTOMATIC FEEDBACK SYSTEMS AND METHODS FOR RAILWAY NIPPER MACHINES

CROSS-REFERENCE

This application claims priority under 35 USC 119(e) from U.S. Provisional Application Ser. No. 61/867,820 filed Aug. 20, 2013.

BACKGROUND

The present disclosure generally relates to railroad maintenance machinery, and more particularly relates to machinery used for lifting up a rail tie close to a rail while performing spiking operations.

Conventional railroad maintenance machine operations include spike pulling, spike driving, tie boring, tie replacement, lag screw application, anchor removing, and other related tasks. Each machine is designed for mechanically performing a specific task under operator control. A nipper is typically located between workheads of the maintenance machine for pulling the tie up to the rail to secure a tie plate to the tie during the driving of spikes into ties, also known as spiking. A main nipper actuator controls up and down positions of the nipper, and an auxiliary actuator controls open and close positions of nipper hooks. The nipper hooks are constructed and arranged for grasping a lower surface of the tie and pulling it upwards toward the rail. A nipper frame is supported by guide blocks on the main machine frame, which are used to guide the nipper frame during reciprocal upward and downward movements.

As is well known in the art, the nipper travels downwardly toward the tie and, under operator control, penetrates the ballast surface to reach a predetermined depth below the tie. Specifically, depending on a zero velocity time period, the nipper automatically digs downwardly into the ballast until the nipper hooks reach a predetermined depth, the hooks close to grasp the tie for the spiking operation. Next, the nipper lifts up the grasped tie so that the tie, the tie plate, and the rail are held tightly together.

Generally, the set time period is sufficient to infiltrate the ballast and reach a safe distance for closing the hooks without damaging the tie. However, when the ballast is resistant to penetration due to, e.g., dense packing of ballast or otherwise inconsistent sections of the railroad track, the operator must manually override the downward operation of the nipper by opening the hooks and retracting the nipper upwardly and downwardly to prevent damage to the tie. Such damage occurs when the nipper does not fully penetrate the ballast and closes the hooks prematurely, thereby destructively pressing against side walls of the tie. This causes not only additional timely repair work, but also unnecessary costly expenses. Thus, there is a need for developing an improved system and method of an automatic nipping operation.

SUMMARY

The present disclosure is directed to a railway nipper machine having an automatic position feedback system. Specifically, the position feedback system improves a timed cycle of a nipping operation, prevents tie damage, and becomes more adaptable to different ballast conditions. As a result, an improved nipping operation is achieved without compromising the operational sequence of the nipper machine.

One aspect of the present machine is that, as described in further detail below, the position feedback system determines whether the nipper hooks have reached a predetermined depth relative to a main nipper actuator. Specifically, if the main nipper actuator does not reach the predetermined depth in a predetermined time period, or a travel velocity of the main nipper actuator is reduced by a predetermined amount before reaching the predetermined depth, the nipper hooks open and close marginally. Such motion of the nipper hooks results in an agitating, digging motion through the ballast, and facilitates downward movement of the hooks to reach the predetermined depth without harming the tie. Additionally, the nipper hooks are optionally actuated upwardly and downwardly during the open and close movements. It will be appreciated that any combination of the agitating, digging, upward, and downward movements is possible depending on the need.

Another important aspect is that the present position feedback system operates the nipper machine automatically without manual operator intervention, and thus saves time during railroad maintenance. More specifically, the cycle time is enhanced as the operator selectively switches the nipper machine between a manual mode and an automatic mode during the nipping operation. Consequently, the cycle time of the nipping operation is significantly reduced. Further, the present position feedback system automatically adapts to various conditions of the ballast while penetrating through the ballast without overriding the nipper sequence.

In a preferred embodiment, a method of performing a nipping operation of the railway nipper machine is provided using the present position feedback system. The method includes the steps of controlling the nipping operation based on a depth signal and a time signal; generating the depth signal relative to a nipper actuator connected to a nipper frame of the nipper machine; generating the time signal using a timer; and actuating the nipper machine using the nipper actuator in response to a determination value generated based on the time signal and the depth signal.

In one embodiment, a railway nipper machine is provided that includes a nipper frame having a pair of nipper hooks for performing a nipping operation, and a position feedback device having a central control module configured for controlling the nipping operation based on a depth signal and a time signal. Further included in the nipper machine is a depth sensor connected to the position feedback device for generating the depth signal relative to a nipper actuator connected to the nipper frame, wherein the depth sensor transmits the depth signal to the position feedback device. A timer is provided for generating the time signal, and the nipper machine is actuated by the nipper actuator in response to a determination value generated by the position feedback device based on the depth signal and the time signal.

In another embodiment, a method for performing a nipping operation of a railway nipper machine is provided that includes performing a nipping operation using a nipper frame having a pair of nipper hooks; controlling the nipping operation based on a depth signal and a time signal; generating the depth signal relative to a nipper actuator connected to the nipper frame using a depth sensor; transmitting the depth signal to the position feedback device; generating the time signal using a timer; and actuating the nipper machine using the nipper actuator in response to a determination value generated based on the depth signal and the time signal.

In still another embodiment, a railway nipper machine is provided and includes a nipper frame having a pair of nipper hooks for performing a nipping operation; a position feedback device having a central control module configured for controlling the nipping operation based on a depth signal; a depth sensor connected to the position feedback device for generating the depth signal relative to a nipper actuator connected to the nipper frame, the depth sensor transmitting the depth signal to the position feedback device; a transducer in operational relationship to the nipper hooks that generates a hook position signal based on a condition of the hooks; and wherein the nipper machine is actuated by the nipper actuator in response to a determination value generated by the position feedback device based on the depth signal and the position signal

DETAILED DESCRIPTION

Figure 1:
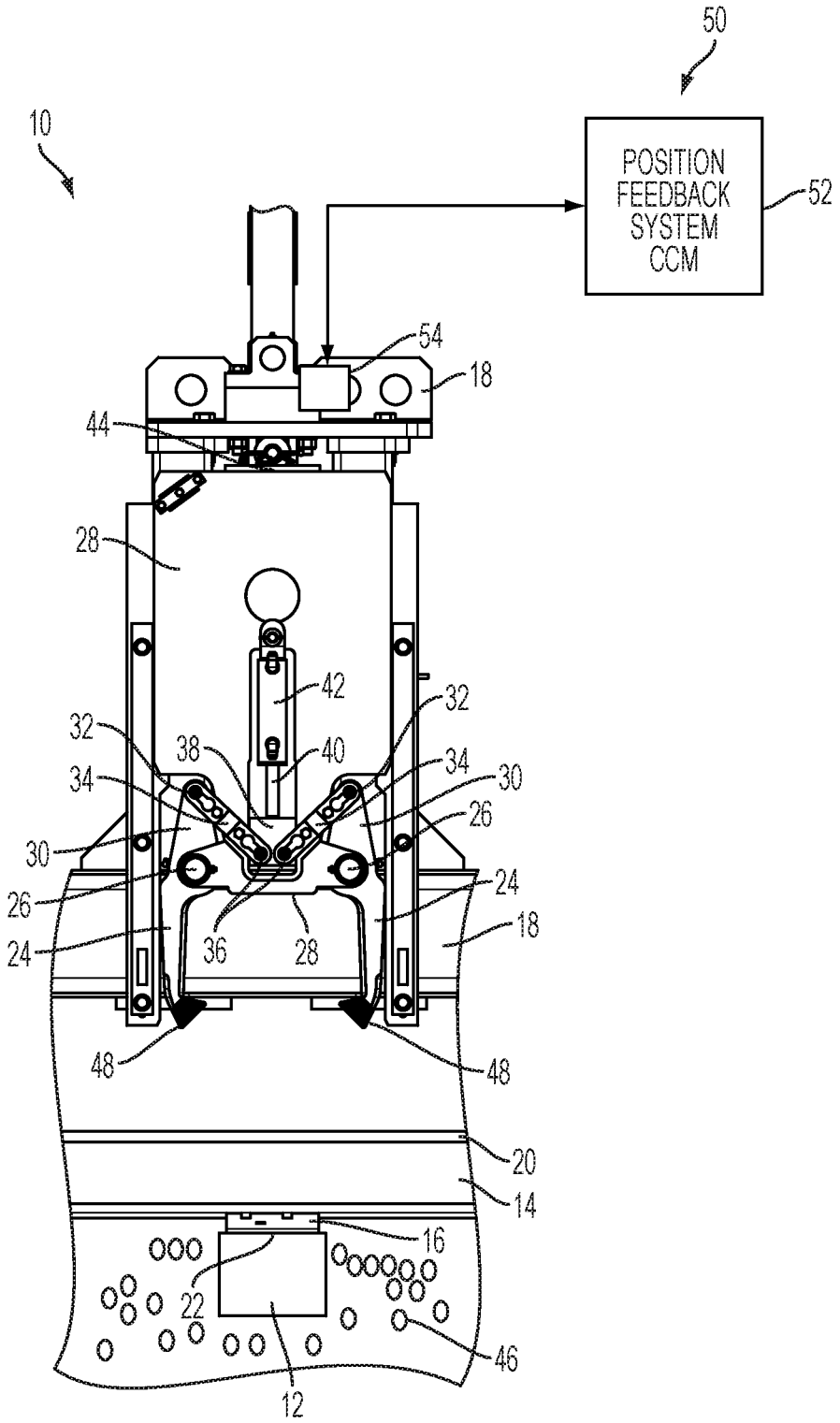
FIG. 1 is a fragmentary side elevation of the present railway nipper machine in a retracted position upon a railway spiker machine.
Figure 2:
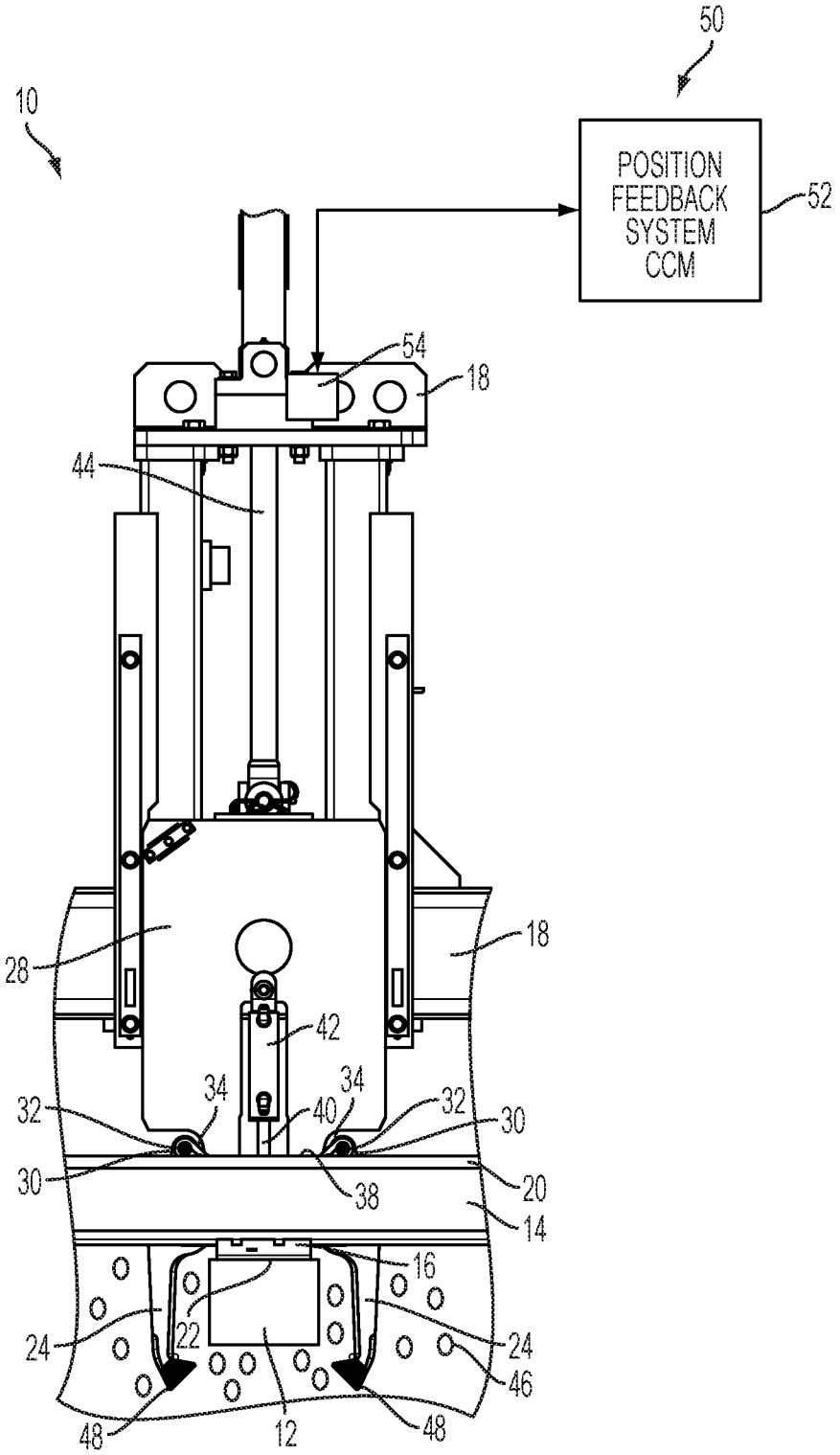
FIG. 2 is a fragmentary side elevation of the nipper machine of FIG. 1 in an extended position.
Figure 3:
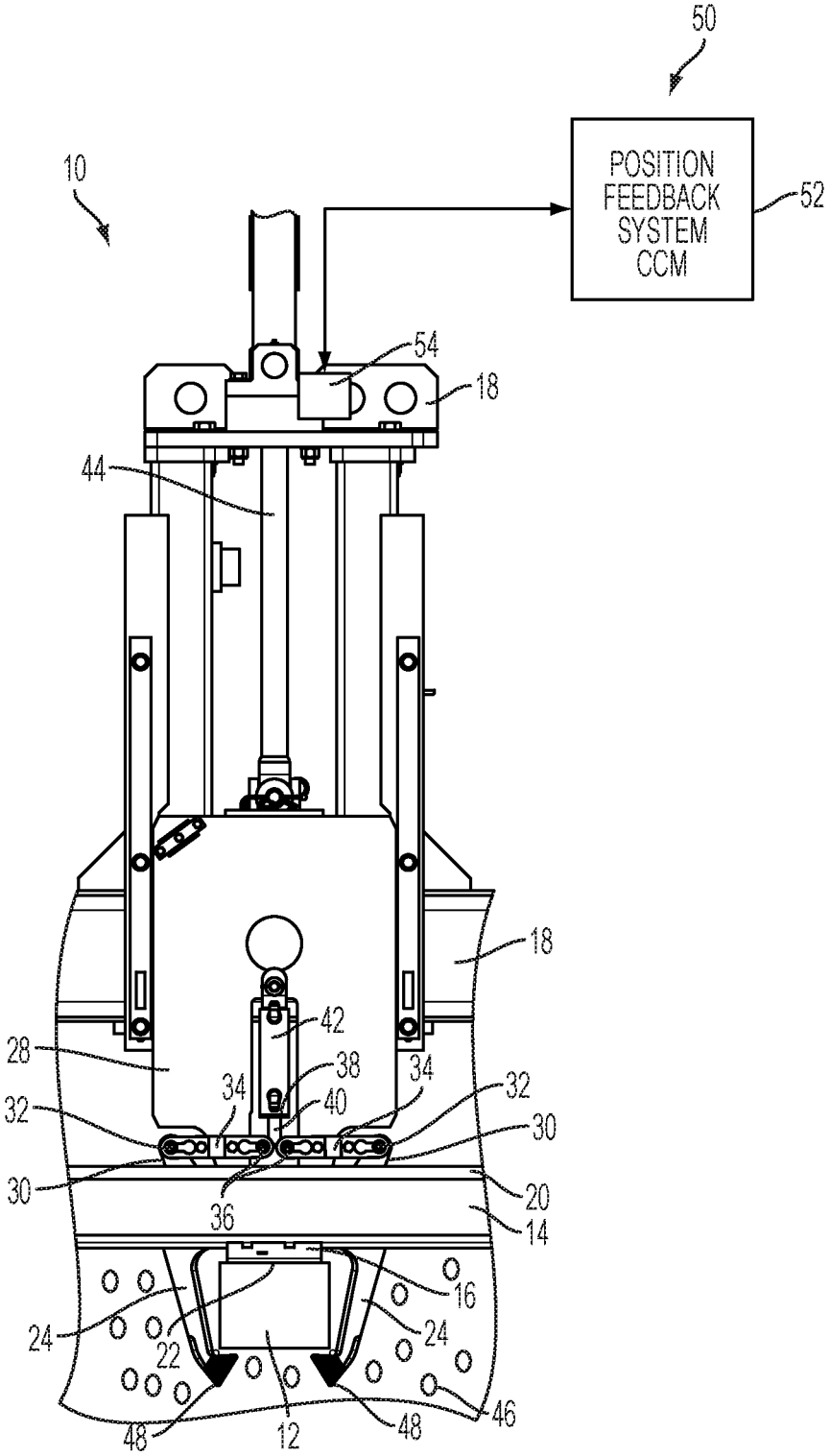
FIG. 3 is a fragmentary side elevation of the nipper machine of FIG. 1 when nipper hooks are in a closed position.

Referring now to FIGS. 1-3, the present railway nipper machine is generally designated 10 and is designed to pull up a tie 12 close to a rail 14 for securing a tie plate 16 to the tie during spiking. Conventionally, the nipper machine 10 is mounted upon a railway maintenance machine or base unit (not shown), having a rail fastener applicator or driver (not shown). Several types of rail fastener applicators or drivers are known, and exemplary models are described in commonly assigned U.S. Pat. Nos. 4,579,061; 4,777,885; 5,191,840; 5,671,679; and 7,104,200; all of which are incorporated by reference.

When the rail fastener applicator drives a fastener, such as a railway cut spike (not shown), into the tie 12, the nipper machine 10 securely holds the tie in position to prevent unnecessary movements of the spike during spiking and to facilitate proper and effective spike placement. As with the rail fastener applicators, exemplary models of the nipper machine 10 are known in the art, and are described in commonly assigned U.S. Pat. Nos. 5,465,667 and 5,586,502; both of which are incorporated by reference.

Connected to the nipper machine 10 is a main railway maintenance machine frame 18 supported on wheels (not shown) such that the frame is constructed and arranged for being movable along a railroad track 20. During the spiking operation, the nipper machine 10 is used for securely grasping the tie 12 against a lower surface 22 of the tie plate 16 to avoid unwanted vertical movement of the tie due to an impact caused by the rail fastener applicator.

Included in the nipper machine 10 is a pair of nipper hooks 24, each having a centrally located main pivot axis 26 pivoting about a nipper frame 28. A rear lobe 30 of each nipper hook 24 has a pivot pin 32 which connects the hook to one end of a hook link 34. The opposite end of the hook link 34 is connected to a pivot pin 36 and to a block 38. A shaft 40 of a fluid power (preferably hydraulic) hook cylinder 42 is connected to the block 38. Another hydraulic nipper actuator or cylinder 44 is provided for controlling vertical movement of the nipper machine 10 relative to the main railway maintenance machine frame 18 between a retracted position and an extended position, where the nipper actuator 44 is connected at one end to the frame 18 and at an opposite end to the nipper frame 28.

A conventional nipping operation begins with the nipper machine 10 in the retracted position with the hooks 24 in an open position (FIG. 1). Maintaining the open position is achieved by extending the shaft 40 downwardly. As a result, the hook links 34 pull the hooks 24 away from each other. Next, the nipper frame 28 is lowered into ballast 46 under the action of the nipper actuator 44 such that lower ends 48 of the hooks 24 are safely below the tie 12 (FIG. 2). Then, as the shaft 40 is retracted, the hooks 24 are closed to hold the tie 12 in clamping relationship, and the cylinder 44 vertically retracts the nipper frame 28. In this manner, the tie 12 is secured against the rail 14 with the tie plate 16 sandwiched in-between, thereby being ready for the spiking operation (FIG. 3).

An important feature of the present nipper machine 10 is that the nipping operation is controlled by a position feedback device or system, generally designated 50. In a preferred embodiment, the position feedback system 50 resides in an actuator transducer, for example, as a software installed computer device having programmable modules for various functions. As used herein, the term "module" may refer to, be part of, or include an Application Specific Integrated Circuit (ASIC), an electronic circuit, a processor (shared, dedicated, or group), a programmable logic controller (PLC) and/or memory (shared, dedicated, or group) that execute one or more software or firmware programs, a combinational logic circuit, and/or other suitable components that provide the described functionality.

Although the children modules residing in their respective parent modules are shown, the broad teachings of the present system can be implemented in a variety of forms. Thus, while this disclosure includes particular examples and arrangements of the modules, the scope of the present device should not be so limited since other modifications will become apparent to the skilled practitioner.

Figure 4:
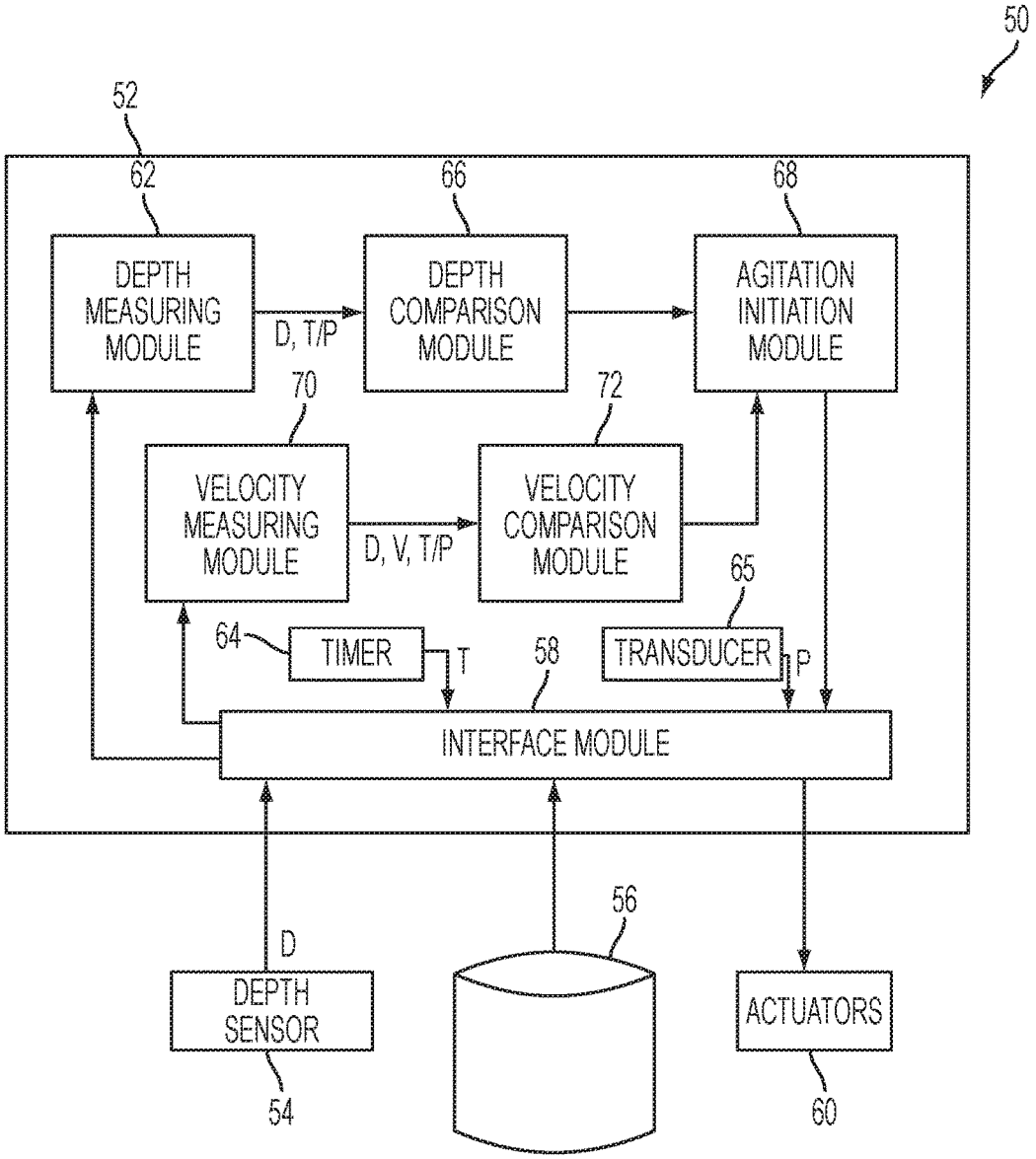
FIG. 4 is a functional block diagram of the present position feedback system featuring functional modules.

Referring now to FIGS. 2 and 4, it is preferred that the present position feedback system 50 includes a central control module (CCM) 52, a depth sensor 54, and a database 56. Overall operation of the feedback system 50 is controlled by the CCM 52. Positional information of the nipper actuator 44 is provided by the depth sensor 54. All relevant information can be stored in the database 56 for retrieval by the CCM 52, e.g., as a data storage device and/or a machine readable data storage medium carrying computer programs. Also included in the CCM 52 is an interface module 58, which provides an interface between the CCM 52, the depth sensor 54, and the database 56. The interface module 58 also controls operation of, for example, actuators 60, such as the hook cylinder 42 and the nipper actuator 44, and other related system devices, services, and applications. The other devices, services, and applications may include, but are not limited to, one or more software or hardware components, as are known in the art. The interface module 58 also receives signals, which are communicated to the respective modules, such as the CCM 52 and its children modules.

During the nipping operation, the opened nipper hooks 24 travel downwardly into the ballast 46 until the hooks reach a predetermined depth in the ballast. Monitoring of the depth is achieved by a depth measuring module 62 that receives a depth signal D from the depth sensor 54 via the interface module 58. A timer 64 is provided to supply a relevant time signal T, such as a start/end time, a current time, and an elapsed time, to the depth measuring module 62. Alternatively, the timer 64 can be replaced by, or supplemented with a transducer 65 located in operational proximity to the hooks 24 for measuring whether the hooks are open or closed due to their position or linear displacement, and generating a hook position signal P. For the purpose of this application, "transducer" will be understood to refer to any electronic position or linear displacement measuring device. A depth comparison module 66 determines whether the predetermined depth has been reached within a predetermined time period based on the time signal T and the depth signal D.

The position feedback system 50 is configured such that in the event the hooks 24 do not reach the predetermined depth, an agitation initiation module 68 starts an agitation sequence of the actuators 60 for a predetermined duration. The agitation sequence refers to a series of orchestrated actuations designed to create a digging motion through the ballast 46 for facilitating the downward movement of the nipper machine 10 as a whole. For example, the nipper hooks 24 open and close marginally under the action of the hook cylinder 42, and alternatively or additionally the nipper frame 28 is lifted and lowered slightly under the action of the nipper actuator 44.

This agitation sequence is also triggered when a downward travel velocity of the nipper actuator 44 is reduced by a predetermined amount before reaching the predetermined depth. Monitoring of the velocity is achieved by a velocity measuring module 70 that receives the depth signal D and the time signal T. Based on the signals D, T, the velocity measure module 70 calculates a velocity V of the nipper actuator 44. A velocity comparison module 72 determines whether the velocity V of the nipper actuator 44 has been reduced by the predetermined amount, and the predetermined depth has not been reached within the predetermined time period.

Figure 5A:
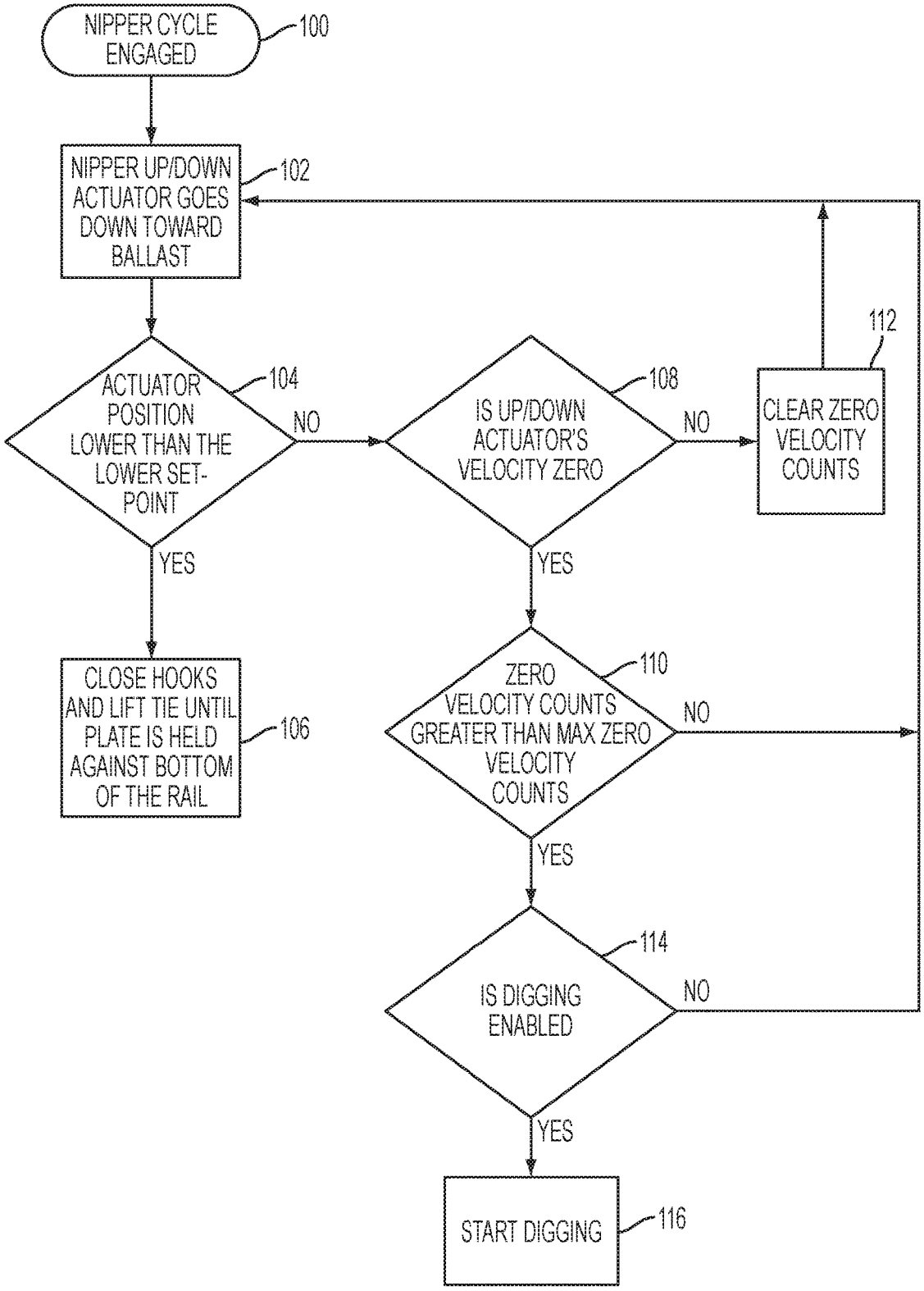
FIGS. 5A and 5B illustrate an exemplary nipping method including a nipper sequence and a digging sequence in accordance with an embodiment of the present disclosure.
Figure 5B:
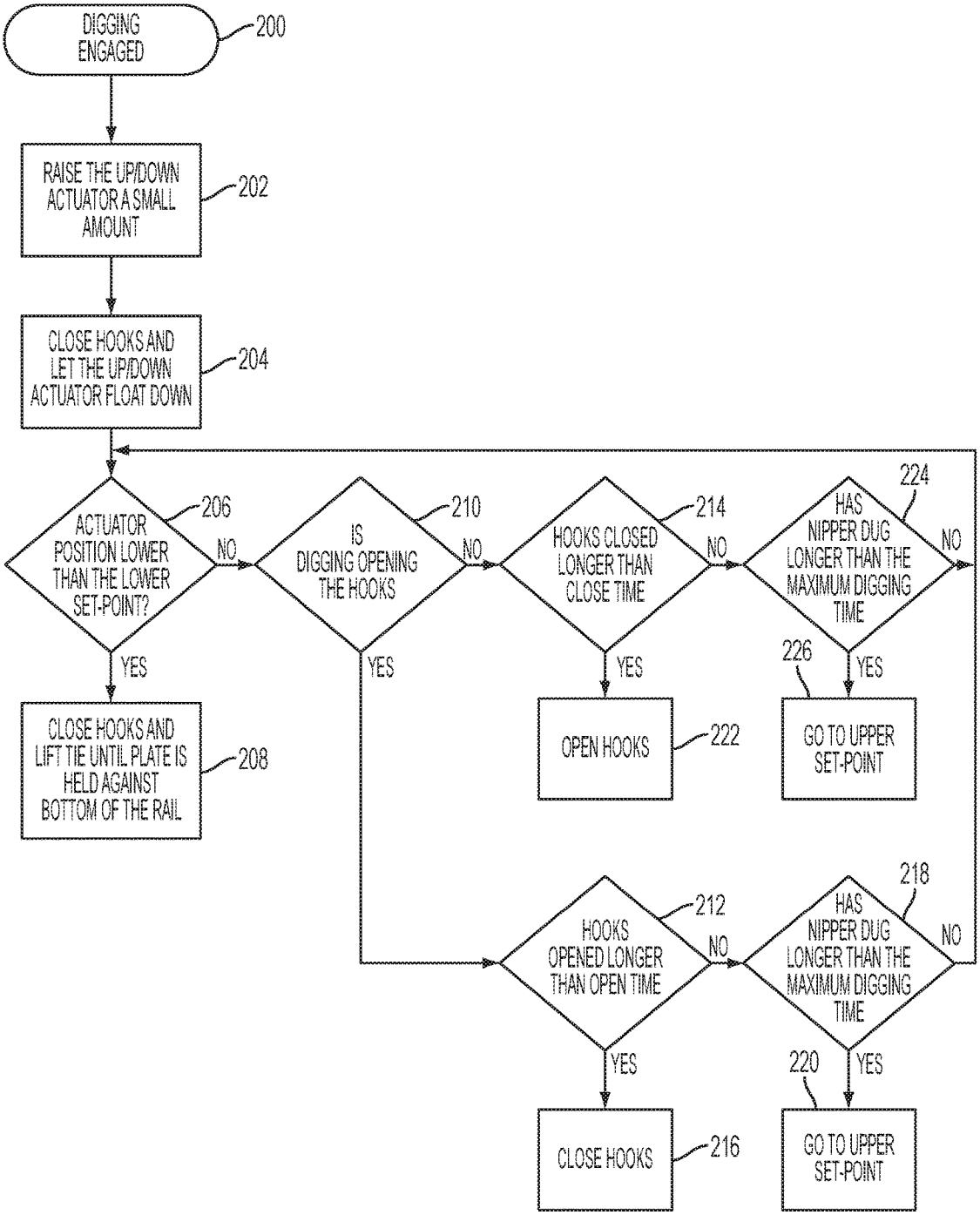

Referring now to FIGS. 5A and 5B, an exemplary method of the present nipping operation using the position feedback system 50 is shown including a nipper sequence (FIG. 5A) and a digging sequence (FIG. 5B). Although the following steps are primarily described with respect to the embodiments of FIGS. 1-4, it should be understood that the steps within the method may be modified and executed in a different order or sequence without altering the principles of the present disclosure.

Referring now to FIG. 5A, an exemplary method of a nipper sequence is illustrated. The method begins at step 100. In step 100, as shown in FIG. 1, the opened nipper hooks 24 are positioned directly over the targeted tie 12, and a nipper cycle is initially engaged. In step 102, the nipper hooks 24 start descending towards the tie 12 in the ballast 46. For example, in an auto-mode, the hooks 24 start to travel downwardly when an operator presses a workhead set position button on a hand controller, or in a manual mode, when the operator triggers a manual nipper button on the hand controller.

In step 104, as shown in FIGS. 2 and 4, the depth measuring module 62 receives the depth signal D from the depth sensor 54 via the interface module 58 as the hooks descend. The depth comparison module 66 generates a first determination value DET1, indicating whether the predetermined depth has been reached within a predetermined time period based on the time signal T and the depth signal D. If the predetermined depth has been reached by the nipper actuator 44 being positioned equal to or lower than a predetermined lower position set-point relative to the rail 14, control proceeds to step 106. Otherwise, control proceeds to step 108. For example only, the first determination value DET1, e.g., Yes (1) or No (0), may be a Boolean value defined as provided by expression 1.

$$DET1=f\{D,T\} \tag{1}$$

In step 106, as shown in FIG. 3, the hooks 24 are closed under the action of the hook cylinder 42, and hold the tie 12 for a predetermined time period. Then, the nipper frame 28 is lifted upwardly under the action of the nipper actuator 44 until the tie plate 16 is held against a bottom of the rail 14 for biasing the tie 12 against the tie plate for the spiking operation.

In step 108, the velocity measuring module 70 calculates the downward travel velocity V of the nipper actuator 44 based on the depth signal D and the time signal T. The velocity comparison module 72 generates a second determination value DET2, indicating whether the velocity V of the nipper actuator 44 has been reduced by the predetermined amount before the predetermined depth is reached within the predetermined time period. For example, the velocity comparison module 72 determines whether the velocity V of the nipper actuator 44 is zero. If the velocity V has been reduced to zero, the velocity comparison module 72 increases a zero velocity counter by one, and control proceeds to step 110. Otherwise, control proceeds to step 112. For example only, the second determination value DET2 may be defined as provided by expression 2.

$$DET2=f\{D,V,T\} \tag{2}$$

In step 110, if a value of the zero velocity counter is greater than a predetermined maximum zero velocity count value, then control proceeds to step 114. Otherwise, control proceeds to step 102. In step 112, the zero velocity counter is cleared by the velocity comparison module 72 such that the value of the counter becomes zero. In step 114, if a digging operation of the nipper machine 10 is enabled, control proceeds to step 116. Otherwise, control proceeds to step 102. In step 116, the digging sequence of the nipper machine 10 is initiated.

Referring now to FIG. 5B, an exemplary method of the digging sequence is illustrated. The method begins at step 200. In step 200, the digging sequence is engaged by the agitation initiation module 68. Specifically, the agitation initiation module 68 starts an agitation sequence of the actuators 60 for a predetermined duration. In step 202, the nipper hooks 24 open and close marginally under the action of the hook cylinder 42, and alternatively or optionally additionally the nipper frame 28 is lifted and lowered slightly under the action of the nipper actuator 44. Control proceeds to step 204 to continue descending of the hooks 24.

In step 204, as shown in FIG. 3, the hooks 24 are closed under the action of the hook cylinder 42 to let the nipper actuator 44 float down further into the ballast 46, and hold the tie 12 for a predetermined time period. In step 206, when the nipper actuator 44 is positioned equal to or lower than the predetermined lower position set-point relative to the rail 14, control proceeds to step 208. Otherwise, control proceeds to step 210.

In step 208, the hooks 24 are closed under the action of the hook cylinder 42, and hold the tie 12 for a predetermined time period. Then, the nipper frame 28 is lifted upwardly under the action of the nipper actuator 44 until the tie plate 16 is held against the bottom of the rail 14 for biasing the tie 12 against the tie plate for the spiking operation.

In step 210, the digging operation in the ballast 46 may cause the nipper hooks 24 to open or close for a predetermined time period. When the agitation initiation module 68 detects that the digging operation causes the hooks 24 to open, control proceeds to step 212. Otherwise, control proceeds to step 214.

In step 212, when the agitation initiation module 68 detects that the hooks 24 are opened longer than a predetermined opened time period, control proceeds to step 216. Otherwise, control proceeds to step 218. In step 216, the agitation initiation module 68 closes the hooks 24 under the action of the hook cylinder 42. In step 218, when the agitation initiation module 68 detects that the digging operation has lasted longer than a predetermined maximum digging time period, control proceeds to step 220. Otherwise, control proceeds to step 206. In step 220, the agitation initiation module 68 repositions the nipper actuator 44 to a predetermined upper position set-point relative to the rail 14.

In step 214, when the agitation initiation module 68 detects that the hooks 24 are closed longer than a predetermined closed time period, control proceeds to step 222. Otherwise, control proceeds to step 224. In step 222, the agitation initiation module 68 opens the hooks 24 under the action of the hook cylinder 42. In step 224, when the agitation initiation module 68 detects that the digging operation has lasted longer than the predetermined maximum digging time period, control proceeds to step 226. Otherwise, control proceeds to step 206. In step 226, the agitation initiation module 68 repositions the nipper actuator 44 to the predetermined upper position set-point relative to the rail 14. Steps 218 and 220 may be modified and executed simultaneously with steps 224 and 226, or alternatively, steps 218 and 220 may be combined with steps 224 and 226 as they are performing the same functions.

Figure 5C:
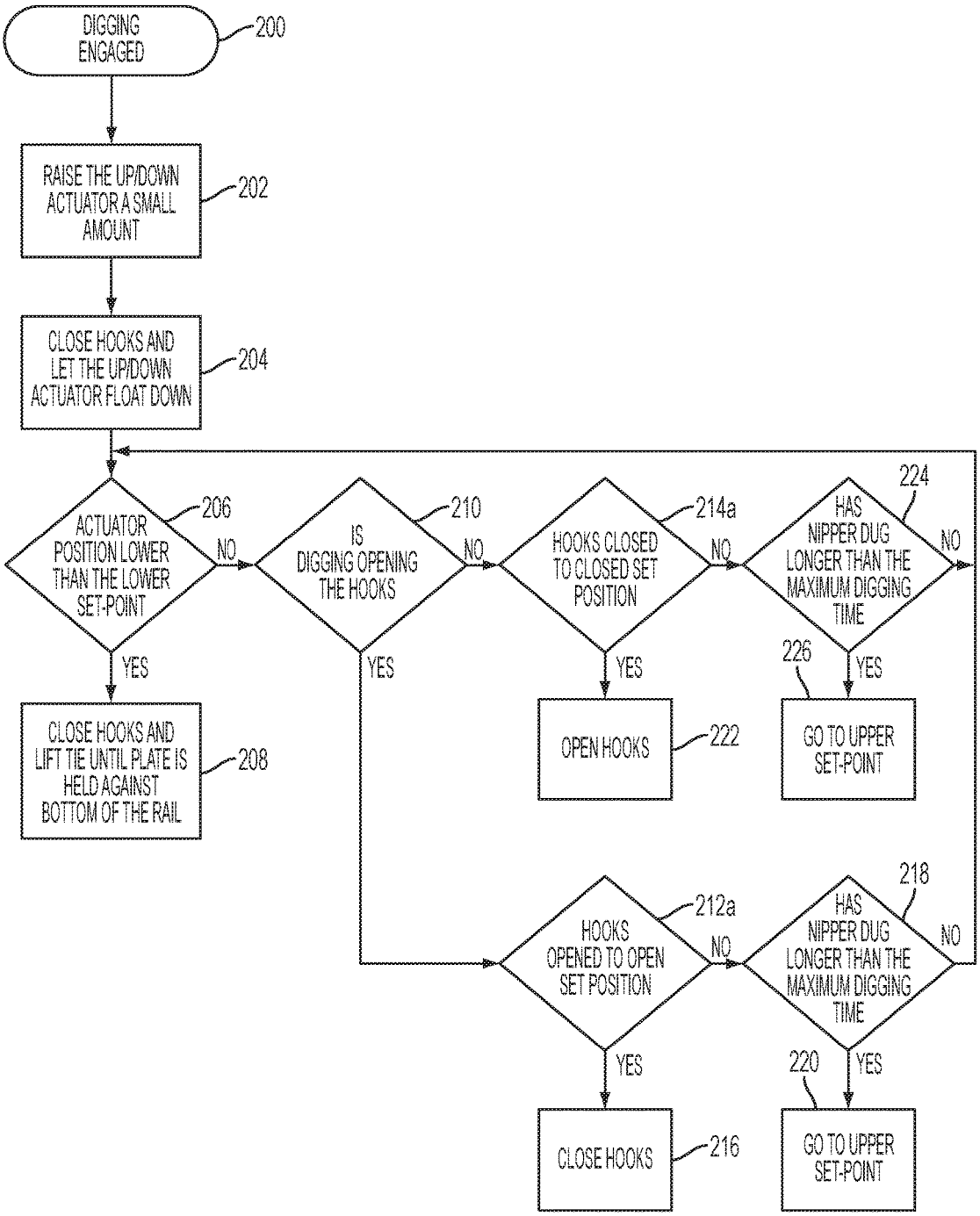
FIG. 5C illustrates an alternate embodiment to the nipping method depicted in FIG. 5B.

Referring now to FIG. 5C, an alternate embodiment to the system of FIG. 5B is depicted. Shared components or steps are designated with identical reference numbers. A main difference between the systems of FIGS. 5B and 5C is that in the former, after step 210, the open/closed time of the hooks 24 is measured to determine whether the hooks should be opened or closed. In contrast, in FIG. 5C, a transducer is employed to measure the position or linear displacement of the hooks 24 and generate a hook position signal. In step 212*a*, when the agitation initiation module 68 detects that the hooks 24 are open by their relative position or linear displacement, they are closed at step 216 through the hook cylinder 42. If the hooks are not sufficiently opened, then, control proceeds to step 218 to measure the nipper digging time as described above.

In step 214*a*, when the agitation initiation module 68 detects that the hooks 24 are closed by their relative position or linear displacement, control proceeds to step 222. Otherwise, control proceeds to step 224. In step 222, the module 68 opens the hooks 24 under the operation of the hook cylinder 42. At step 224, the system operates as described above in relation to FIG. 5B.

While a particular embodiment of the present nipper machine has been described herein, it will be appreciated by those skilled in the art that changes and modifications may be made thereto without departing from the present disclosure in its broader aspects and as set forth in the following claims.

What is claimed is:

1. A railway nipper machine, comprising:

a nipper frame having a pair of nipper hooks for performing a nipping operation;

a position feedback device having a central control module configured for controlling the nipping operation based on a depth signal and a time signal, wherein the central control module includes a depth comparison module configured for determining whether a predetermined depth relative to the nipper actuator has been reached within a predetermined time period based on the time signal and the depth signal;

a depth sensor connected to the position feedback device for generating the depth signal relative to a nipper actuator connected to the nipper frame, the depth sensor transmitting the depth signal to the position feedback device;

a timer that generates the time signal; and wherein the nipper machine is actuated by the nipper actuator in response to a determination value generated by the position feedback device based on the depth signal and the time signal.

2. The railway nipper machine of claim 1, wherein the central control module includes an interface module configured for providing an interface between the central control module and the depth sensor.

3. The railway nipper machine of claim 1, wherein the central control module includes a depth measuring module configured for receiving the depth signal from the depth sensor via an interface module.

4. The railway nipper machine of claim 3, wherein the timer supplies the time signal to the depth measuring module, and the time signal includes at least one of a start or end time, a current time, and an elapsed time.

5. The railway nipper machine of claim 1, wherein the central control module includes an agitation initiation module configured for starting an agitation sequence of the actuator for a predetermined duration.

6. The railway nipper machine of claim 5, wherein the agitation sequence includes a series of orchestrated actuations designed to create a digging motion through ballast for facilitating a downward movement of the nipper machine.

7. The railway nipper machine of claim 5, wherein the agitation sequence is triggered when a downward travel velocity of the nipper actuator is reduced by a predetermined amount before reaching a predetermined depth.

8. The railway nipper machine of claim 1, wherein the central control module includes a velocity measuring module configured for receiving the depth signal and the time signal, and the velocity measure module calculates a velocity of the nipper actuator based on the depth and time signals.

9. The railway nipper machine of claim 1, wherein the central control module includes a velocity comparison module that determines whether a velocity of the nipper actuator has been reduced by a predetermined amount, and a predetermined depth relative to the nipper actuator has not been reached within a predetermined time period.

10. A method for performing a nipping operation of a railway nipper machine, comprising:

performing a nipping operation using a nipper frame having a pair of nipper hooks;

controlling the nipping operation based on a depth signal and a time signal;

generating the depth signal relative to a nipper actuator connected to the nipper frame using a depth sensor;

transmitting the depth signal to a position feedback device;

generating the time signal using a timer; and actuating the nipper machine using the nipper actuator in response to a determination value generated based on the depth signal and the time signal; and determining whether a predetermined depth relative to the nipper actuator has been reached within a predetermined time period based on the time signal and the depth signal.

11. The method of claim 10, further comprising controlling operation of the nipper actuator via an interface between the depth sensor and associated components of the nipper machine.

12. The method of claim 10, further comprising receiving the depth signal from the depth sensor for indicating an amount of depth of the nipper hooks in ballast.

13. The method of claim 12, further comprising supplying the time signal including at least one of a start or end time, a current time, and an elapsed time.

14. The method of claim 10, further comprising starting an agitation sequence of the actuator for a predetermined duration.

15. The method of claim 14, wherein the agitation sequence includes a series of orchestrated actuations designed to create a digging motion through ballast for facilitating a downward movement of the nipper machine.

16. The method of claim 14, wherein the agitation sequence is triggered when a downward travel velocity of the nipper actuator is reduced by a predetermined amount before reaching a predetermined depth.

17. The method of claim 10, further comprising receiving the depth signal and the time signal, and calculating a velocity of the nipper actuator based on the depth and time signals.

18. The method of claim 10, further comprising determining whether a velocity of the nipper actuator has been reduced by a predetermined amount, and a predetermined depth relative to the nipper actuator has not been reached within a predetermined time period.

19. A railway nipper machine, comprising:

a nipper frame having a pair of nipper hooks for performing a nipping operation;

a position feedback device having a central control module configured for controlling the nipping operation based on a depth signal and a time signal, the central control module including an agitation initiation module configured for starting an agitation sequence of the actuator for a predetermined duration, wherein the agitation sequence is triggered when a downward travel velocity of the nipper actuator is reduced by a predetermined amount before reaching a predetermined depth;

a depth sensor connected to the position feedback device for generating the depth signal relative to a nipper actuator connected to the nipper frame, the depth sensor transmitting the depth signal to the position feedback device;

a timer that generates the time signal; and wherein the nipper machine is actuated by the nipper actuator in response to a determination value generated by the position feedback device based on the depth signal and the time signal.

20. A railway nipper machine, comprising:

a nipper frame having a pair of nipper hooks for performing a nipping operation;

a position feedback device having a central control module configured for controlling the nipping operation based on a depth signal and a time signal, the central control module including a velocity comparison module that determines whether a velocity of the nipper actuator has been reduced by a predetermined amount, and a predetermined depth relative to the nipper actuator has not been reached within a predetermined time period;

a depth sensor connected to the position feedback device for generating the depth signal relative to a nipper actuator connected to the nipper frame, the depth sensor transmitting the depth signal to the position feedback device;

a timer that generates the time signal; and wherein the nipper machine is actuated by the nipper actuator in response to a determination value generated by the position feedback device based on the depth signal and the time signal.

21. A method for performing a nipping operation of a railway nipper machine, comprising:

performing a nipping operation using a nipper frame having a pair of nipper hooks;

controlling the nipping operation based on a depth signal and a time signal;

generating the depth signal relative to a nipper actuator connected to the nipper frame using a depth sensor;

transmitting the depth signal to the position feedback device;

generating the time signal using a timer;

actuating the nipper machine using the nipper actuator in response to a determination value generated based on the depth signal and the time signal;

starting an agitation sequence of the actuator for a predetermined duration; and receiving the depth signal and the time signal, and calculating a velocity of the nipper actuator based on the depth and time signals.

22. A method for performing a nipping operation of a railway nipper machine, comprising:

performing a nipping operation using a nipper frame having a pair of nipper hooks;

controlling the nipping operation based on a depth signal and a time signal;

generating the depth signal relative to a nipper actuator connected to the nipper frame using a depth sensor;

transmitting the depth signal to the position feedback device;

generating the time signal using a timer; and actuating the nipper machine using the nipper actuator in response to a determination value generated based on the depth signal and the time signal; and determining whether a velocity of the nipper actuator has been reduced by a predetermined amount, and a predetermined depth relative to the nipper actuator has not been reached within a predetermined time period.

* * * * *